US011199030B2

(12) United States Patent
Bejune et al.

(10) Patent No.: US 11,199,030 B2
(45) Date of Patent: Dec. 14, 2021

(54) CLOSURE SYSTEM THAT RESISTS SEPARATION WHEN LATERALLY LOADED

(71) Applicant: Ford Global Technologies, LLC, Dearborn, MI (US)

(72) Inventors: Daniel Bejune, Southfield, MI (US); Barton Heldke, Novi, MI (US); Huanan Tong, Canton, MI (US); Jason Sobick, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 830 days.

(21) Appl. No.: 15/904,839

(22) Filed: Feb. 26, 2018

(65) Prior Publication Data

US 2019/0264472 A1 Aug. 29, 2019

(51) Int. Cl.
*E05B 85/04* (2014.01)
*E05B 77/04* (2014.01)
(Continued)

(52) U.S. Cl.
CPC ..... *E05B 77/04* (2013.01); *E05B 79/04* (2013.01); *E05B 83/18* (2013.01); *E05B 85/04* (2013.01); *E05C 3/004* (2013.01); *E05C 3/12* (2013.01); *E05B 81/06* (2013.01); *E05Y 2201/434* (2013.01); *E05Y 2600/46* (2013.01);
(Continued)

(58) Field of Classification Search
CPC ..... Y10T 292/68; Y10T 292/683; Y10T 292/685; Y10T 292/688; Y10T 292/691; E05B 77/04; E05B 79/04; E05B 85/04; E05B 77/12
See application file for complete search history.

(56) References Cited

U.S. PATENT DOCUMENTS 2,689,758 A * 9/1954 Orr ..... E05B 85/22 292/194
6,010,164 A 1/2000 Yoda
(Continued)

FOREIGN PATENT DOCUMENTS

CN 204311877 5/2015
CN 105019743 11/2015
(Continued)

OTHER PUBLICATIONS

Translation of DE10019587, Oct. 25, 2001.*
(Continued)

*Primary Examiner* — Carlos Lugo
(74) *Attorney, Agent, or Firm* — David Coppiellie. , Esq.; Carlson, Gaskey & Olds, P.C.

(57) ABSTRACT

An exemplary closure system includes, among other things, a striker assembly, a latch assembly, and a hooked structure. In response to the striker assembly and the latch assembly being laterally displaced from each other, the hooked structure engages one of the striker assembly or the latch assembly to block separation of the striker assembly from the latch assembly. An exemplary latching method includes, among other things, engaging a hooked structure in response to a striker assembly being laterally displaced relative to a latch assembly. The engaging blocks the striker assembly from separating relative to the latch assembly.

18 Claims, 6 Drawing Sheets

(51) Int. Cl.

| | |
|---|---|
| ***E05C 3/00*** | (2006.01) |
| ***E05C 3/12*** | (2006.01) |
| ***E05B 79/04*** | (2014.01) |
| ***E05B 83/18*** | (2014.01) |
| *E05B 81/06* | (2014.01) |

(52) U.S. Cl.
CPC ... *E05Y 2600/626* (2013.01); *E05Y 2800/252* (2013.01); *E05Y 2900/548* (2013.01); *Y10T 292/68* (2015.04)

(56) References Cited

U.S. PATENT DOCUMENTS

| | | | | |
|---|---|---|---|---|
| 7,025,395 | B2 * | 4/2006 | Fisher | E05B 15/0006 292/340 |
| 7,029,043 | B2 * | 4/2006 | Fisher | E05B 15/0006 292/341.13 |
| 8,938,913 | B2 * | 1/2015 | Thompson | H02B 1/38 49/394 |
| 9,316,021 | B2 * | 4/2016 | Burciaga | E05B 15/0295 |
| 9,347,246 | B2 | 5/2016 | Orzech et al. | |
| 9,631,402 | B2 * | 4/2017 | Bejune | E05B 17/0062 |

FOREIGN PATENT DOCUMENTS

| | | | | |
|---|---|---|---|---|
| DE | 10019587 | A1 * | 10/2001 | E05B 83/24 |
| DE | 102006002972 | A1 * | 8/2007 | E05B 15/022 |
| EP | 2149659 | A1 * | 2/2010 | E05B 79/20 |
| FR | 2980404 | A1 * | 3/2013 | E05B 79/06 |
| FR | 3033353 | A1 * | 9/2016 | E05B 77/04 |
| GB | 409095 | A * | 4/1934 | E05B 17/2088 |
| JP | 2004148877 | A * | 5/2004 | |
| JP | 2007253784 | A * | 10/2007 | |
| JP | 6168557 | | 7/2017 | |

OTHER PUBLICATIONS

Tranlation of FR 3033353, Sep. 9, 2015.*
Translation of JP 2004148877, May 27, 2004.*
Translation of JP 2007253784, Oct. 4, 2007.*

* cited by examiner

CLOSURE SYSTEM THAT RESISTS SEPARATION WHEN LATERALLY LOADED

TECHNICAL FIELD

This disclosure relates generally to a closure system. More particularly, the disclosure relates to a closure system that includes features to prevent a closure panel, for example, a trunk lid, from opening in response to a lateral load.

BACKGROUND

Vehicles include various closure panels, such as hoods, trunk lids, and doors. The closure panels are moveable between open and closed positions. When the closure panels are in a closed position, closure systems can be used to secure the closure panels to a vehicle body. To move the closure panels from the closed position, a user can transition the associated closure system from a latched position to an unlatched position.

In response to a load applied to the vehicle, the closure system may become unlatched. A closure panel with that closure system could then open. Some vehicles may desire the closure panel to remain in a closed after a load is applied. Examples of such vehicles can include specialty vehicles, such as law enforcement vehicles. Keeping, for example, a trunk lid from opening after a side impact can prevent the trunk compartment from becoming accessible.

SUMMARY

A closure system, according to an exemplary embodiment of the present disclosure includes, among other things, a striker assembly, a latch assembly, and a hooked structure. In response to the striker assembly and the latch assembly being laterally displaced from each other, the hooked structure engages one of the striker assembly or the latch assembly to block separation of the striker assembly from the latch assembly.

A further non-limiting embodiment of the foregoing system includes a striker pin of the striker assembly and a catch of the latch assembly. The catch grasps the striker pin when the closure system is in a latched position.

In a further non-limiting embodiment of any of the foregoing systems, the lateral displacement is from the latched position.

In a further non-limiting embodiment of any of the foregoing systems, the striker assembly and the latch assembly secure a trunk lid to a vehicle body in a closed position when the striker assembly and the latch assembly are in the latched position.

In a further non-limiting embodiment of any of the foregoing systems, the trunk lid rotates about an axis when moving back and forth from an open position to the closed position. The lateral displacement is in a direction that is parallel to the axis.

A further non-limiting embodiment of any of the foregoing systems includes a striker pin of the striker assembly and a catch of the latch assembly. The hooked structure includes a first hook on a first lateral side of the striker pin and a second hook on an opposite, second lateral side of the striker pin.

A further non-limiting embodiment of any of the foregoing systems includes a first aperture that is engaged by the hooked structure in response to lateral displacement in a first direction, and a second aperture that is engaged by the hooked structure in response to lateral displacement in an opposite, second direction.

A further non-limiting embodiment of any of the foregoing systems includes a striker pin extending from a base plate of the striker assembly, a first loop extending from the base plate on a first lateral side of the striker pin, and a second loop extending from the base plate on an opposite, second lateral side of the striker pin. The first aperture is provided by the first loop. The second aperture is provided by the second loop.

A further non-limiting embodiment of any of the foregoing systems includes a striker pin and a base plate of the striker assembly. The first aperture is provided by an upturned flange of the base plate on a first lateral side of the striker pin. The second aperture is provided by an upturned flange of the base plate on an opposite, second lateral side of the striker pin.

A further non-limiting embodiment of any of the foregoing systems includes a hook plate that provides the hooked structure. The hook plate is secured directly to the latch assembly.

A latching method according to another exemplary aspect of the present disclosure includes, among other things, engaging a hooked structure in response to a striker assembly being laterally displaced relative to a latch assembly. The engaging blocks the striker assembly from separating relative to the latch assembly.

In a further non-limiting embodiment of the foregoing method, blocking the striker assembly from separating relative to the latch assembly blocks a trunk lid from moving from a closed position to an open position relative to a vehicle body.

In a further non-limiting embodiment of any of the foregoing methods, the lateral displacement is with reference to a lateral side of the vehicle body.

A further non-limiting embodiment of any of the foregoing methods includes rotating a trunk lid about an axis to move the trunk lid from an open position to a closed position relative to a vehicle body. The method further includes grasping a striker pin of the striker assembly with a catch of the latch assembly to secure the striker assembly to the latch assembly in a latched position that holds the trunk lid in a closed position. The lateral displacement is in a direction that is parallel to the axis.

In a further non-limiting embodiment of any of the foregoing methods, the grasping occurs when the trunk lid is in the closed position.

In a further non-limiting embodiment of any of the foregoing method, a first hook of the hooked structure engages a first aperture in response to lateral displacement in a first direction, and a second hook of the hooked structure engages a second aperture in response to lateral displacement in an opposite, second direction.

A further non-limiting embodiment of any of the foregoing methods includes grasping a striker pin of the striker assembly with a catch of the latch assembly to secure the striker assembly to the latch assembly in a latched position. The first hook is on a first lateral side of the striker pin. The second hook is on an opposite, second side of the striker pin.

A further non-limiting embodiment of any of the foregoing methods includes deforming a striker pin of the striker assembly during the engaging.

A further non-limiting embodiment of any of the foregoing methods includes providing the hooked structure within a hook plate that is secured directly to the latch assembly.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a closure system that can transition to a latched position to secure a closure panel of a vehicle in a closed position. The closure system incorporates features that help to maintain the closure panel in the closed position even when the closure system has unlatched in response to lateral loads causing portions of the closure system to shift laterally relative to each other.

Figure 1:
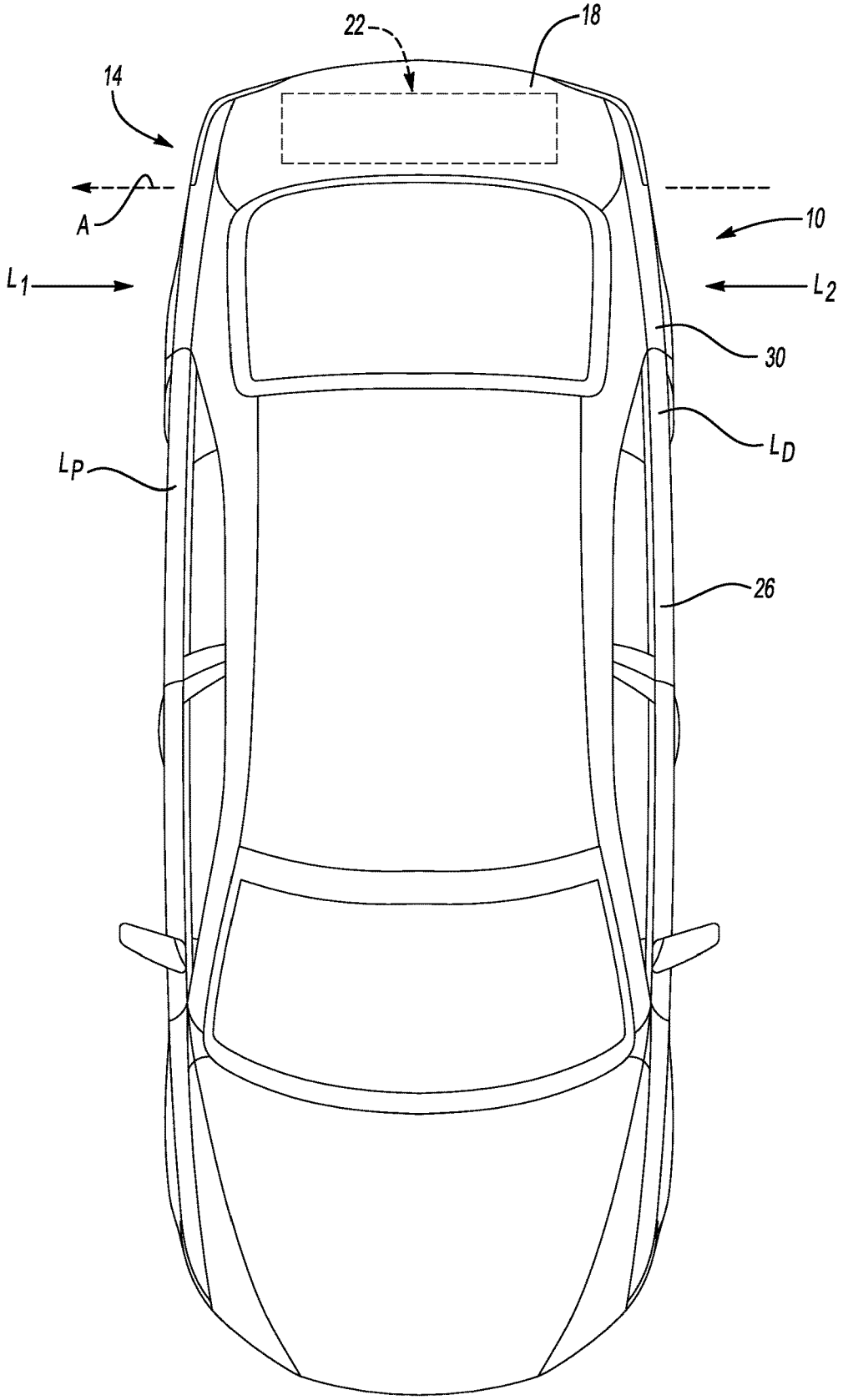
FIG. 1 shows a top view of a rear portion of an exemplary vehicle.

Referring now to FIG. 1, an exemplary vehicle 10 includes a rear area 14 having a trunk lid 18 in a closed position where the trunk lid 18 covers a trunk compartment 22. The trunk lid 18 pivots about an axis A to move from an open position to the closed position of FIG. 1. Generally, when the trunk lid 18 is in the open position, the trunk compartment 22 is accessible from outside the vehicle 10. Also, when the trunk lid 18 is in the closed position, the trunk compartment 22 is substantially inaccessible from outside the vehicle 10.

The trunk lid 18 is an example closure panel of the vehicle 10. Other closure panels of the vehicle 10 can include side doors 26 and a hood (not shown). The closure panels of the vehicle 10 can be pivotably secured to a vehicle body structure 30. The closure panels can be secured in closed positions relative to the vehicle body structure 30 via closure systems.

Figure 2:
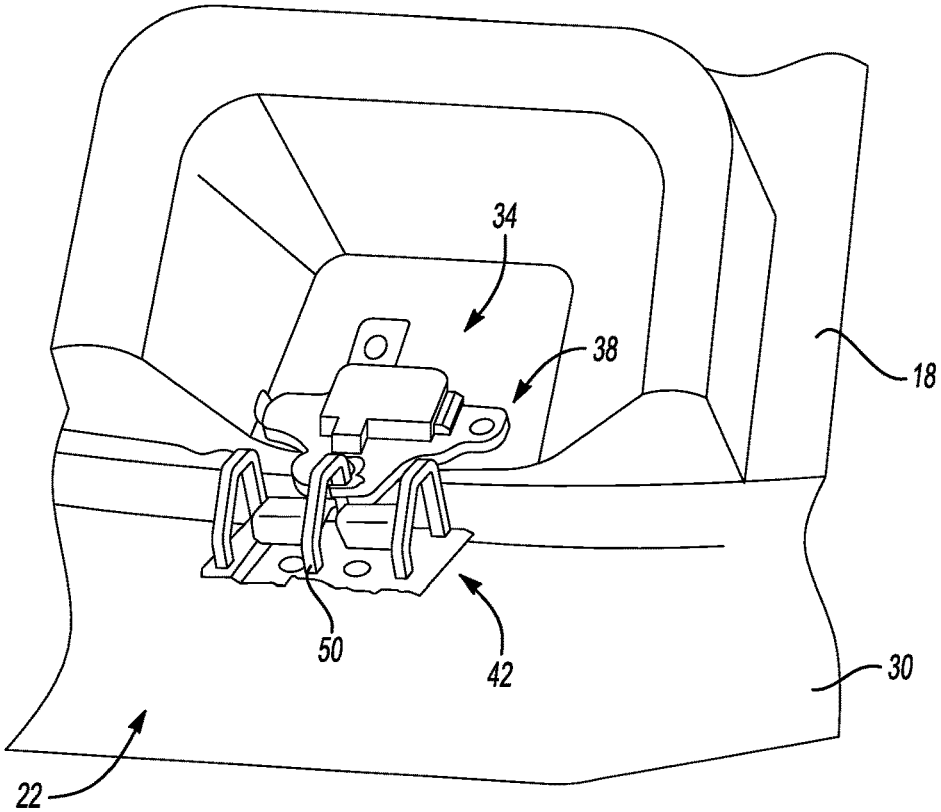
FIG. 2 shows a view from within a trunk compartment of the vehicle FIG. 1 showing selected portions of a closure system utilized to secure a trunk lid of the vehicle of FIG. 1 in a closed position.
Figure 3:
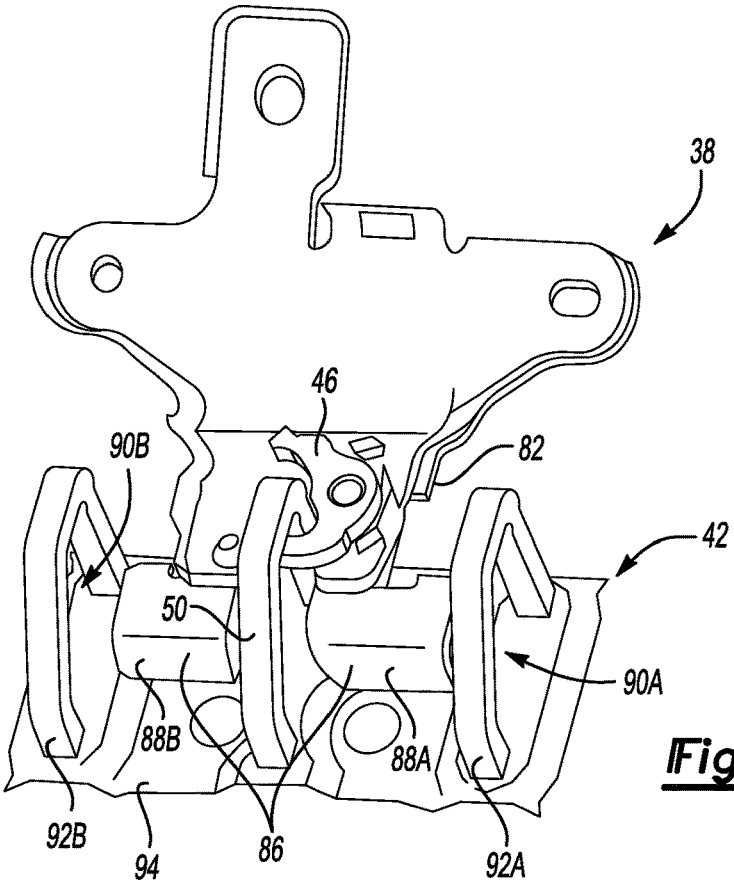
FIG. 3 shows a close-up view of the selected portions of the closure system from FIG. 2 in a latched position.

Referring now to FIGS. 2 and 3, an exemplary closure system 34 can be used to secure the trunk lid 18 in a closed position relative to the vehicle body structure 30. The closure system 34 can be in a latched position when securing the trunk lid 18 to the vehicle body structure 30.

The closure system 34 generally includes a latch assembly 38 and a striker assembly 42. In the latched position, a catch 46 of the latch assembly 38 grasps a striker pin 50 of the striker assembly 42.

Figure 4:
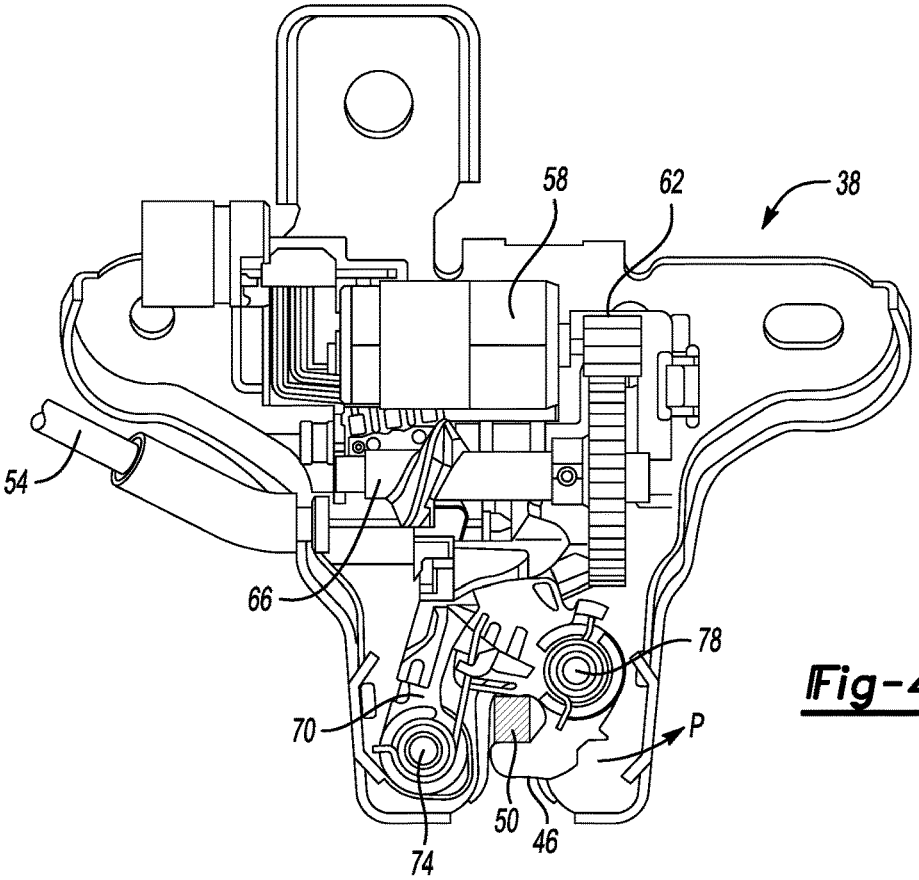
FIG. 4 shows portions of a latch assembly used in connection with the closure system of FIG. 3.

With reference to FIG. 4 and continued reference to FIGS. 2 and 3, the latch assembly 38 can additionally include a Bowden cable 54, an electric motor 58, an electric motor pinion 62, an output gear and cam 66, and a pawl 70. Some or all of these components could be contained within a housing (not showing in FIG. 4).

The pawl 70 can selectively prevent the catch 46 from rotating and releasing the striker pin 50. To release the catch 46 from grasping the striker pin 50, the cable 54 can be pulled to pivot the pawl 70 about a pivot 74.

Pivoting the pawl 70 pivots the catch 46 in a direction P about a pivot 78 to release the catch 46 from grasping the striker pin 50. When the striker pin 50 is no longer grasped by the catch 46, the closure system 34 is unlatched. If not otherwise prevented, the trunk lid 18 can be moved to an open position relative to the vehicle body structure 30 to provide access to the trunk compartment 22 when the closure system 34 is in an unlatched position.

During ordinary operation, the catch 46 can be rotated about the pivot 78 to move the latch to the unlatched position via the electric motor 58 rotating the pinion 62 to move the output gear and cam 66. A rotation of the output gear and cam 66 pivots the pawl 70 about the pivot 74 to cause the catch 46 to rotate about the pivot 78 in the direction P.

Figure 5:
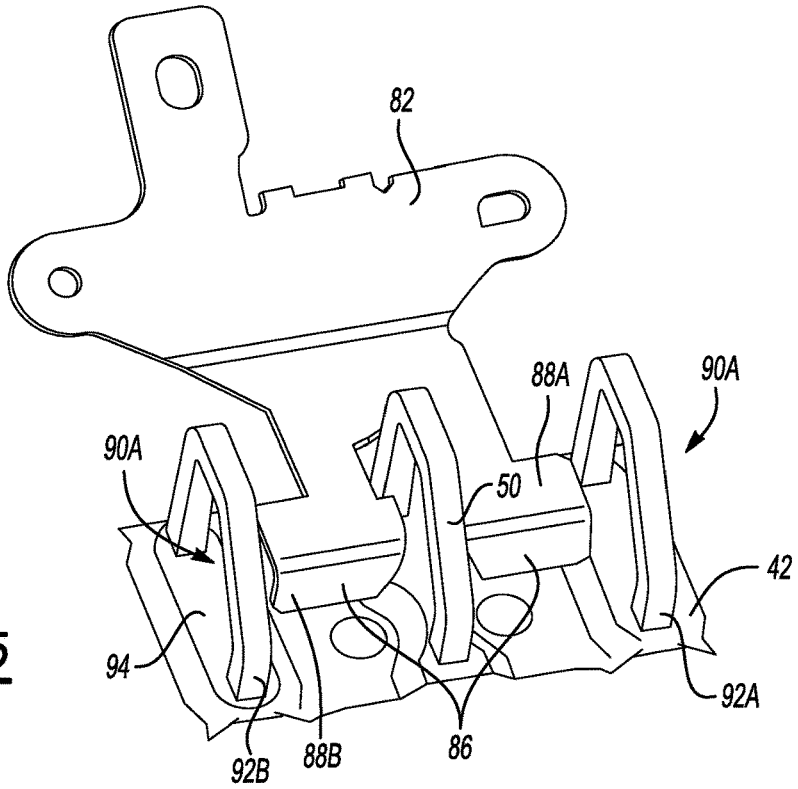
FIG. 5 shows a hook plate and a striker assembly of the closure system of FIG. 3.
Figure 6:
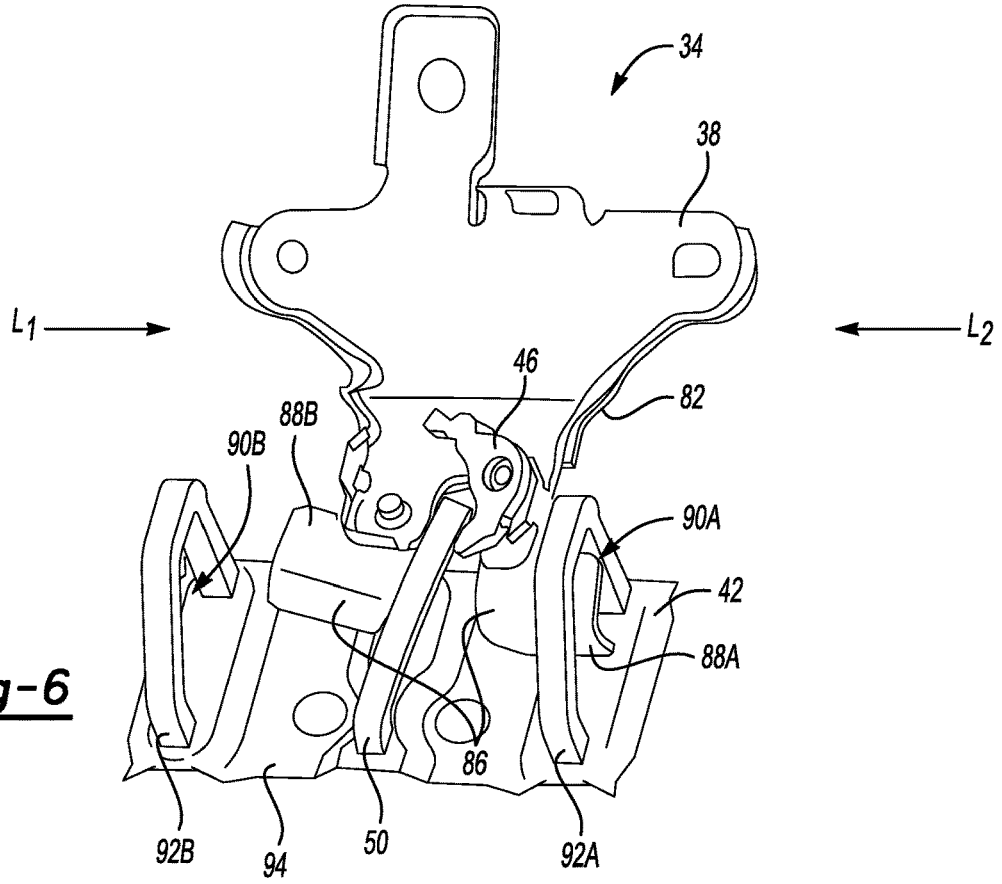
FIG. 6 shows the selected portions of the closure system from FIG. 3 after a lateral load has caused the latch assembly of the closure system to move laterally relative to a striker assembly of the closure system.
Figure 7:
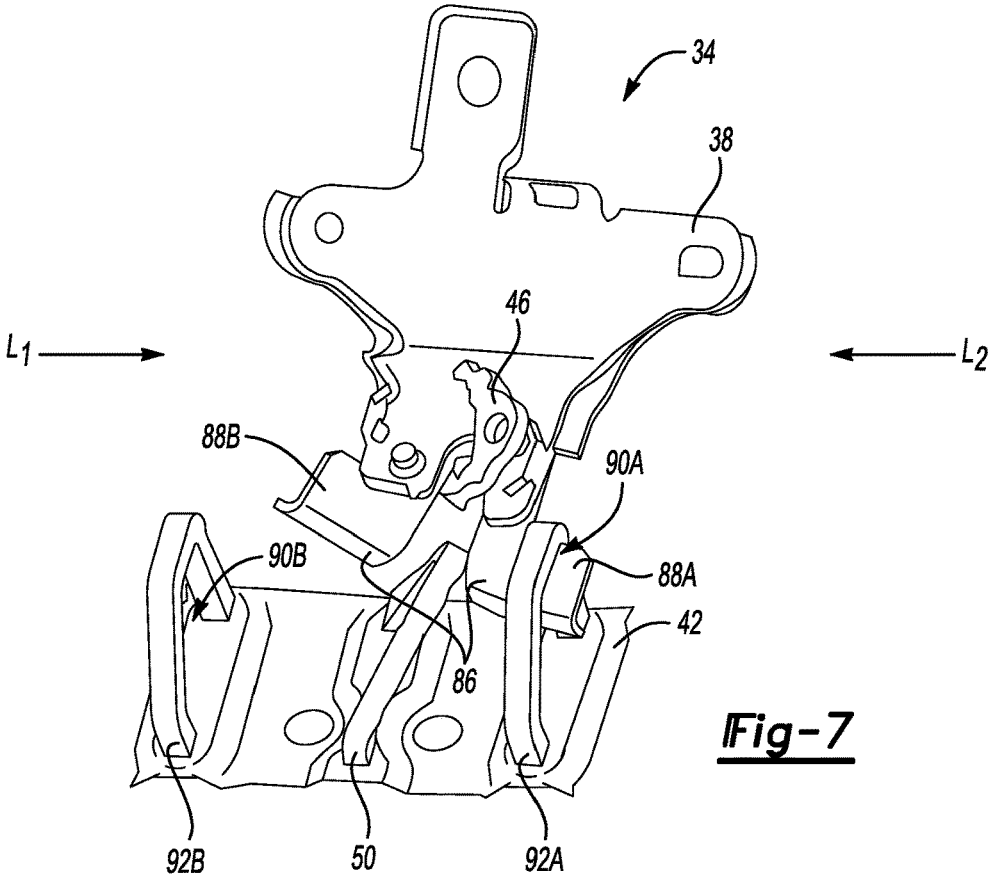
FIG. 7 shows the selected portions of the closure system of FIG. 6 after the latch assembly has been displaced laterally relative to the striker assembly further than the position of FIG. 6.

Referring now to FIG. 5, in this exemplary embodiment, a hook plate 82 is secured to the latch assembly 38. The hook plate 82 has a hooked structure 86 with a first hook 88A and a second hook 88B. The hook plate 82 can be secured over the latch assembly 38 without requiring substantial modifications to the latch assembly 38. The hook plate 82, in this example, is secured, with the latch assembly 38, to an interior surface of the trunk lid 18 via orbital rivets. Other examples could secure the latch assembly 38 and the hook plate 82 in other ways.

The hook plate 82 with the hooked structure 86 could be retrofitted to a vehicle having the latch assembly 38 shown in FIG. 4. Similarly, if the hook plate 82 is not desired, the latch assembly 38 shown in FIG. 4 could be used without the hook plate 82.

With reference to FIGS. 1 and 3, a lateral load $L_1$ could be applied to a laterally facing passenger side $L_P$ of the vehicle 10 when the trunk lid 18 is in the closed position and the closure system 34 is in the latched position. The lateral load $L_1$ could be an impact load caused by another vehicle striking the vehicle 10 on a passenger side. Lateral, for purposes of this disclosure, is with reference to an orientation of the vehicle 10 having the closure system 34.

A lateral load $L_2$ could instead be applied to a laterally facing driver side $L_D$ of the vehicle 10. The load $L_2$ could be applied by another vehicle striking the vehicle 10 on a driver side.

The lateral loads $L_1$ or $L_2$, if above a threshold amount, could cause the latch assembly 38 to become laterally displaced relative to the striker assembly 42. Sufficient lateral displacement could cause the catch 46 to move away from a position where the catch 46 grasps the striker pin 50. If not accounted for, the trunk lid 18 could then move from the closed position to an open position, which may be undesirable. The hooked structure 86 of the exemplary closure system 34 helps to ensure that the trunk lid 18 effectively remains in the closed position even when the latch assembly 38 and the striker assembly 42 are laterally displaced relative to each other.

For example, with reference to FIGS. 1, 3, 6, and 7, as the lateral load $L_1$ is applied to the closure system 34, the latch assembly 38 and the striker assembly 42 to become displaced relative to each other. The latch assembly 38 and the striker assembly 42 are laterally displaced relative to each other from the position of FIG. 3, to the position in FIG. 6, and then to the position of FIG. 7. Portions of the latch assembly 38, such as the pawl 70, are omitted in FIGS. 3, 6, and 7 for drawing clarity.

As the latch assembly 38 and the striker assembly 42 are laterally displaced relative to one another in response to the lateral load $L_1$, the hook 88A gradually engages with the striker assembly 42. Specifically, in this exemplary embodiment, the hook 88A engages the striker assembly 42 via receipt of the hook 88A within an aperture 90A of the striker assembly 42. The relative lateral displacement of the latch assembly 38 and the striker assembly 42 is in a direction that is substantially aligned with the axis of rotation A of the trunk lid 18.

The striker pin 50 can bend in response to the lateral displacement causing portions of the latch assembly 38 to move against the striker pin 50. The bending and relative movement could cause the catch 46 to move away from a position where the catch 46 grasps the striker pin 50. However, due to the receipt of the first hook 88A within the aperture 90A, the trunk lid 18 is blocked from moving to an open position where the trunk compartment 22 would be accessible from outside the vehicle 10.

In the exemplary non-limiting embodiment, the aperture 90A is provided by a first loop 92A of the striker assembly 42 on a first lateral side of the striker pin 50. The receipt of the hook 88A within the aperture 90A prevents the latch assembly 38 from moving upwards and separating from the striker assembly 42. Preventing separation of the latch assembly 38 and the striker assembly 42 prevents the trunk lid 18 from moving to the open position.

As can be appreciated, a lateral displacement of the latch assembly 38 relative to the striker assembly 42 in response to the lateral load $L_2$ would cause the hook 88B to move within a corresponding aperture 90B provided by a second loop 92B of the striker assembly 42. While the first loop 92A is on the first lateral side of the striker pin 50, the second loop 92B is on an opposing, second side of the striker pin 50.

The loops 92A and 92B can be wires that are welded to a base 94 of the striker assembly 42. The striker pin 50 can also be a wire welded in a loop form to the base 94. In other examples, the loops 92A, 92B, and striker pin 50 can be orbitally upset to the base 94.

Although described in connection with the hook plate 82 with the hook structure 86 being secured to the latch assembly 38, other examples are contemplated that could include the striker assembly 42 having hook plate with a hooked structure configured to engage a corresponding aperture on the latch assembly 38. Further, the striker assembly 42 could instead be on the closure panel and the latch assembly 38 on the vehicle body 30.

In this disclosure, like reference numerals designate like elements where appropriate, and reference numerals with the addition of one-hundred or multiples thereof designate modified elements. The modified elements incorporate the same features and benefits of the corresponding modified elements, expect where stated otherwise.

Figure 8:
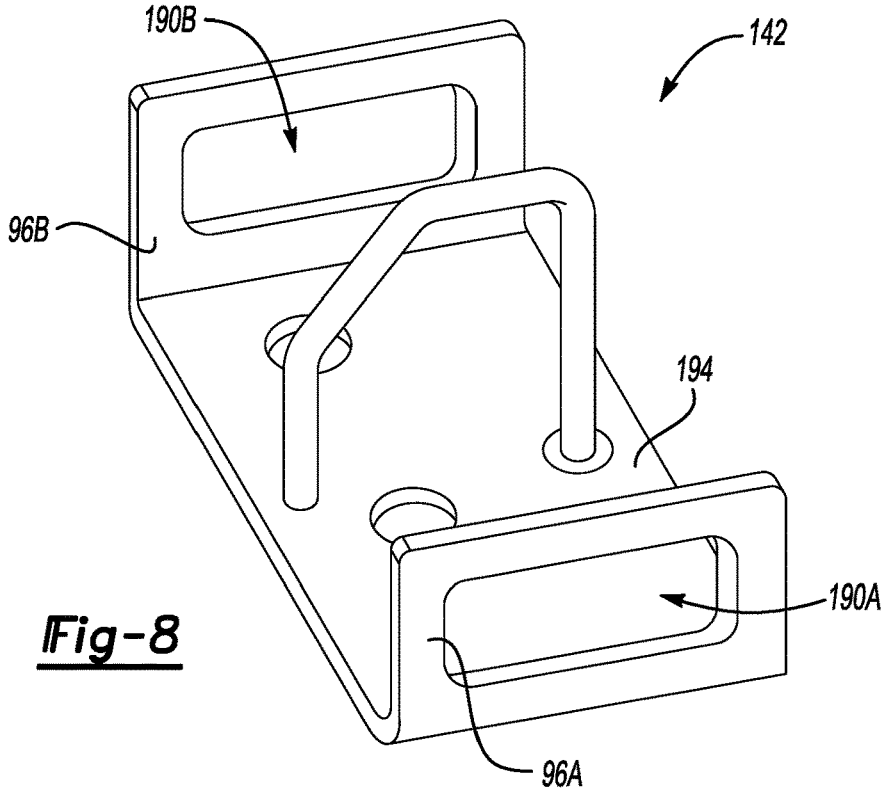
FIG. 8 shows a striker assembly of a closure system according to another exemplary embodiment.

With reference now to FIG. 8, another exemplary non-limiting embodiment of a closure system could include a striker assembly 142 incorporating a first aperture 190A and a second aperture 190B within a respective upturned flange 96A and 96B at opposite lateral sides of the base 194. The upturned flanges 96A and 96B are formed as continuous monolithic portions of the base 194.

The first aperture 190A and the second aperture 190B could receive hooks 88A and 88B (FIG. 5), respectively, in response to a lateral load applied to a passenger side of a vehicle or to a driver side of a vehicle. Receipt of the hooks 88A or 88B within the respective aperture 190A or 190B can block a latch assembly from separating from the striker assembly 142 thereby blocking a trunk compartment, or other area, from becoming accessible from outside a vehicle.

Figure 9:
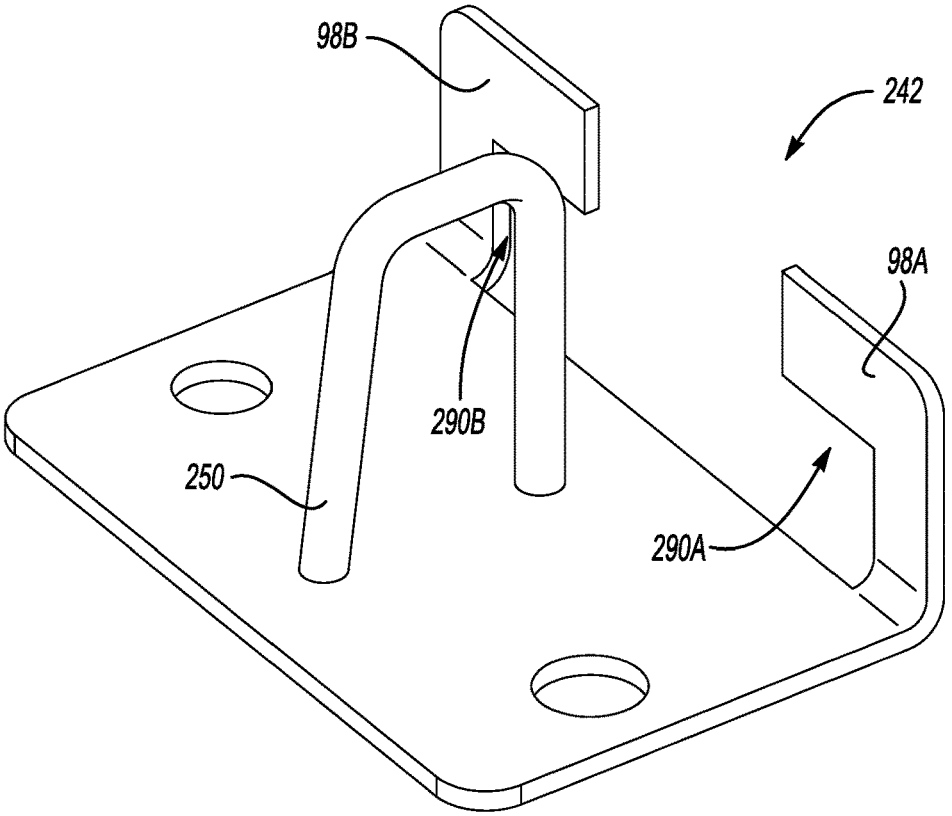
FIG. 9 shows a striker assembly of a closure system according to yet another exemplary embodiment.

With reference now to FIG. 9, yet another example striker assembly 242 can include apertures 290A and 290B provided by hooks 98A and 98B on opposite sides of a striker pin 250. The apertures 290A and 290B open to a side facing the striker pin 250. The apertures 290A and 290B thus do not have their entire periphery defined by the striker assembly 242 as do the apertures 90A and 90B of the striker assembly 42 (FIG. 3) and the apertures 190A and 190B of the striker assembly 142 (FIG. 8).

The first aperture 290A and the second aperture 290B could receive hooks 88A and 88B (FIG. 5), respectively, in response to a lateral load applied to a passenger side of a vehicle or to a driver side of a vehicle. Receipt of the hooks 88A or 88B within the respective aperture 290A or 290B can block a latch assembly from separating from the striker assembly 142 thereby preventing a trunk compartment, or other area, from becoming accessible from outside a vehicle.

Figure 10:
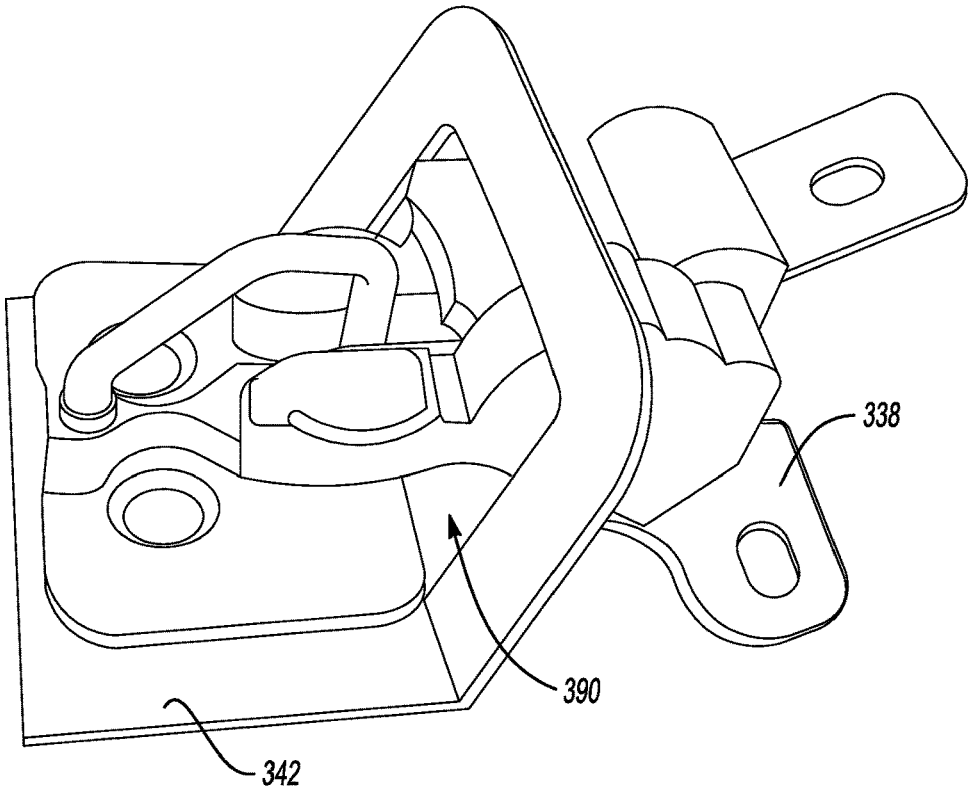
FIG. 10 shows a striker assembly and a latch assembly of a closure system according to still another exemplary embodiment.

With reference now to FIG. 10, yet another exemplary striker assembly 342 can include an aperture 390 that receives a portion of a latch assembly 338 when a closure panel is in a closed position, and also resists separation of the latch assembly 338 from the striker assembly 342 in response to relative lateral displacement between the latch assembly 338 and the striker assembly 342.

Even with the portions of the latch assembly 338 shift laterally relative to the striker assembly 342, portions of the latch assembly 338 can remain within the aperture 390 and bounded by the striker assembly 342. The portions of the latch assembly 338 within the aperture 390 can contact the striker assembly 342 to block the latch assembly 338 from separating from the striker assembly 342 thereby preventing a trunk compartment, or other area, from becoming accessible from outside a vehicle.

Figure 11:
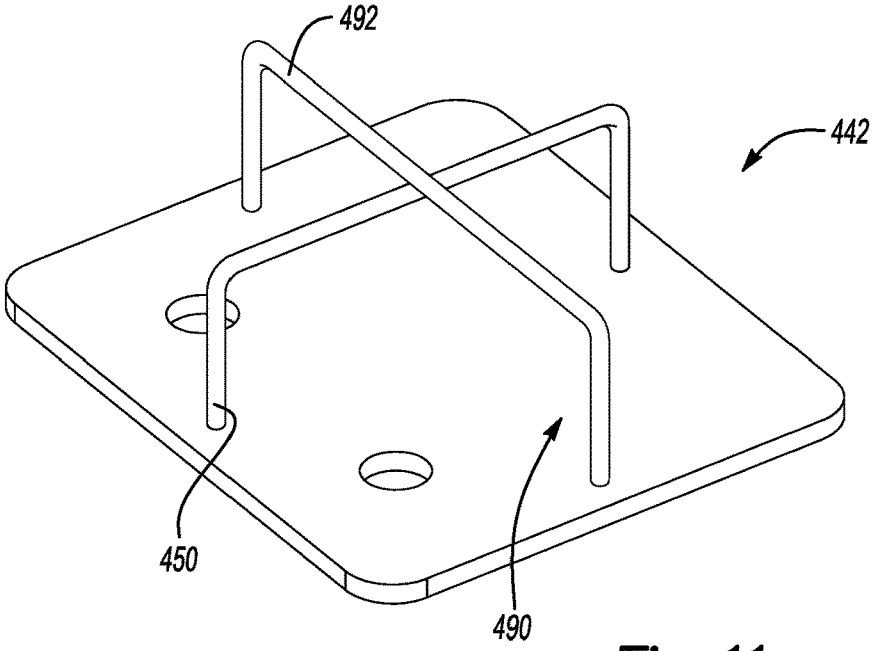
FIG. 11 shows a striker assembly of a closure system according to still another exemplary embodiment of the present disclosure.

With reference now to FIG. 11, yet another exemplary striker assembly 442 includes an aperture 490 provided by a loop 492A extending from a first lateral side of a striker pin 450 to an opposing, second lateral side of the striker pin 450. When a latch assembly is in a latched position where the latch assembly grasps the striker pin 450, portions of the latch assembly are received within the aperture 490. Should the portions of the latch assembly shift laterally relative to the striker assembly 442 due to a lateral load, some of the latch assembly can remain within the aperture 490 and bounded by the loop 492A. Contact between the loop 492A and the latch assembly can block the latch assembly from separating from the striker assembly 442 thereby preventing a trunk compartment from becoming accessible from outside a vehicle.

Features of the disclosed examples include a closure system incorporating features that help to maintain a closure panel in a substantially closed position in response to a lateral load. Among other things, the closure system can include hooked structures that move together with one of the striker assembly or the latch assembly to engage features on the other of the striker assembly or the latch assembly in response to a lateral load. When engaged, the hooked structures prevent or block separation of the latch assembly from the striker assembly to prevent the closure panel from opening.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A closure system, comprising:

a striker assembly;

a latch assembly; and a hook plate having a hooked structure that is disengaged from the striker assembly and latch assembly, in response to a lateral load causing the striker assembly and the latch assembly to be laterally displaced relative to each other, engages one of the striker assembly or the latch assembly to block separation of the striker assembly from the latch assembly, wherein the hook plate is secured to one of the striker assembly or the latch assembly, and further comprising a first aperture and a second aperture in the other of the striker assembly or the latch assembly, the first aperture engaged by the hooked structure in response to lateral displacement in a first direction, the second aperture engaged by the hooked structure in response to lateral displacement in an opposite, second direction.

2. The closure system of claim 1, further comprising a striker pin of the striker assembly and a catch of the latch assembly, the catch grasping the striker pin when the closure system is in a latched position.

3. The closure system of claim 2, wherein the lateral displacement is from the latched position.

4. The closure system of claim 2, wherein the striker assembly and the latch assembly secures a trunk lid to a vehicle body in a closed position when the striker assembly and the latch assembly are in the latched position.

5. The closure system of claim 4, wherein the trunk lid rotates about an axis when moving back and forth from an open position to the closed position, wherein the lateral displacement is in in a direction that is parallel to the axis.

6. The closure system of claim 1, further comprising a striker pin of the striker assembly and a catch of the latch assembly, wherein the hooked structure includes a first hook on a first lateral side of the striker pin and a second hook on an opposite, second lateral side of the striker pin.

7. The closure system of claim 1, further comprising a striker pin extending from a base plate of the striker assembly, a first loop extending from the base plate on a first lateral side of the striker pin, and a second loop extending from the base plate on an opposite, second lateral side of the striker pin, the first aperture provided by the first loop, the second aperture provided by the second loop.

8. The closure system of claim 1, further comprising a striker pin and a base plate of the striker assembly, the first aperture provided by an upturned flange of the base plate on a first lateral side of the striker pin, the second aperture provided by an upturned flange of the base plate on an opposite, second lateral side of the striker pin.

9. The closure system of claim 1, further comprising the hook plate secured directly to the latch assembly.

10. A latching method, comprising:

latching a latch assembly and a striker assembly; and from a disengaged position, engaging a hooked structure of a hook plate in response to a lateral load causing the striker assembly to be laterally displaced relative to the latch assembly, the engaging blocking the striker assembly from separating relative to the latch assembly, wherein the hook plate is secured to one of the striker assembly or the latch assembly, and a first aperture and a second aperture are in the other of the striker assembly or the latch assembly, wherein a first hook of the hooked structure engages the first aperture in response to lateral displacement in a first direction, and a second hook of the hooked structure engages the second aperture in response to lateral displacement in an opposite, second direction.

11. The latching method of claim 10, wherein blocking the striker assembly from separating relative to the latch assembly blocks a trunk lid from moving from a closed position to an open position relative to a vehicle body.

12. The latching method of claim 11, wherein the lateral displacement is with reference to a lateral side of the vehicle body.

13. The latching method of claim 10, further comprising rotating a trunk lid about an axis to move the trunk lid from an open position to a closed position relative to a vehicle body, and grasping a striker pin of the striker assembly with a catch of the latch assembly to secure the striker assembly to the latch assembly in a latched position that holds the trunk lid in the closed position, wherein the lateral displacement is in in a direction that is parallel to the axis.

14. The latching method of claim 13, wherein the grasping occurs when the trunk lid is in the closed position.

15. The latching method of claim 10, grasping a striker pin of the striker assembly with a catch of the latch assembly to secure the striker assembly to the latch assembly in a latched position, the first hook on a first lateral side of the striker pin, the second hook on an opposite, second side of the striker pin.

16. The latching method of claim 10, further comprising deforming a striker pin of the striker assembly during the engaging.

17. The latching method of claim 10, further comprising providing the hooked structure within the hook plate that is secured directly to the latch assembly.

18. A closure system, comprising:

a striker assembly comprising a base plate, a striker pin extending from the base plate; a first loop extending from the base plate on a first lateral side of the striker pin, and a second loop extending from the base plate on an opposite, second lateral side of the striker pin, the first loop at least partially defining a first aperture and the second loop at least partially defining a second aperture;

a latch assembly configured latch with the striker pin; and a hook plate secured directly to the latch assembly and comprising a hooked structure defining first and second lateral hook, that, in response to the striker assembly and the latch assembly being laterally displaced from each other during a collision, from a disengaged position transition to engage(s) a respective one of the first and second apertures of the striker assembly to block separation of the striker assembly from the latch assembly.

* * * * *